US006101643A

United States Patent [19]

Moore

[11] Patent Number: 6,101,643

[45] Date of Patent: Aug. 15, 2000

[54] PORTABLE HOT SINK SYSTEM

[76] Inventor: Sherlann D. Moore, P.O. Box 9591, Las Vegas, Nev. 89191

[21] Appl. No.: 09/195,823

[22] Filed: Nov. 19, 1998

[51] Int. Cl.[7] ..... A47K 1/02

[52] U.S. Cl. ..... 4/631; 4/638; 4/640; 4/643; 4/653; 134/105

[58] Field of Search ..... 4/539, 545, 619, 4/631, 638, 639, 640, 642, 643, 653; 607/85, 86, 87; 134/105

[56] References Cited

U.S. PATENT DOCUMENTS

| | | | |
|---|---|---|---|
| 1,121,340 | 12/1914 | Ellis | 4/545 |
| 1,389,050 | 8/1921 | Jarrett | 4/545 X |
| 1,474,872 | 11/1923 | Witt | 4/643 X |
| 2,481,564 | 9/1949 | Bjorkman | 607/86 |
| 4,236,771 | 12/1980 | Summers | 4/638 X |
| 4,934,152 | 6/1990 | Templeton | 4/655 X |
| 5,845,661 | 12/1998 | Leppo | 134/105 X |

FOREIGN PATENT DOCUMENTS

| | | | |
|---|---|---|---|
| 131308 | 6/1929 | Switzerland | 4/642 |

*Primary Examiner*—Robert M. Fetsuga

[57] ABSTRACT

A portable hot sink system comprising a frame having two parallel upper elongated tubes with a first end and a second end. The system also comprises a first inverted U-shaped support with two intermediate cross braces and an upper cross handle. A second inverted U-shaped support is provided with three substantially similarly sized and shaped tubs. Each tub has closed rectangular lower ends and four upwardly extending generally rectangular vertical walls and with upper open ends. The central tub shares a common wall with the adjacent tubs. Drains are located within each of the tubs. Lastly, a heating element is located within a vertical wall of each tub with electrical lines coupling the heating elements to a common control element with a common light at the control element to illuminate until the preselected temperature of about 180 degrees Fahrenheit is reached.

5 Claims, 3 Drawing Sheets

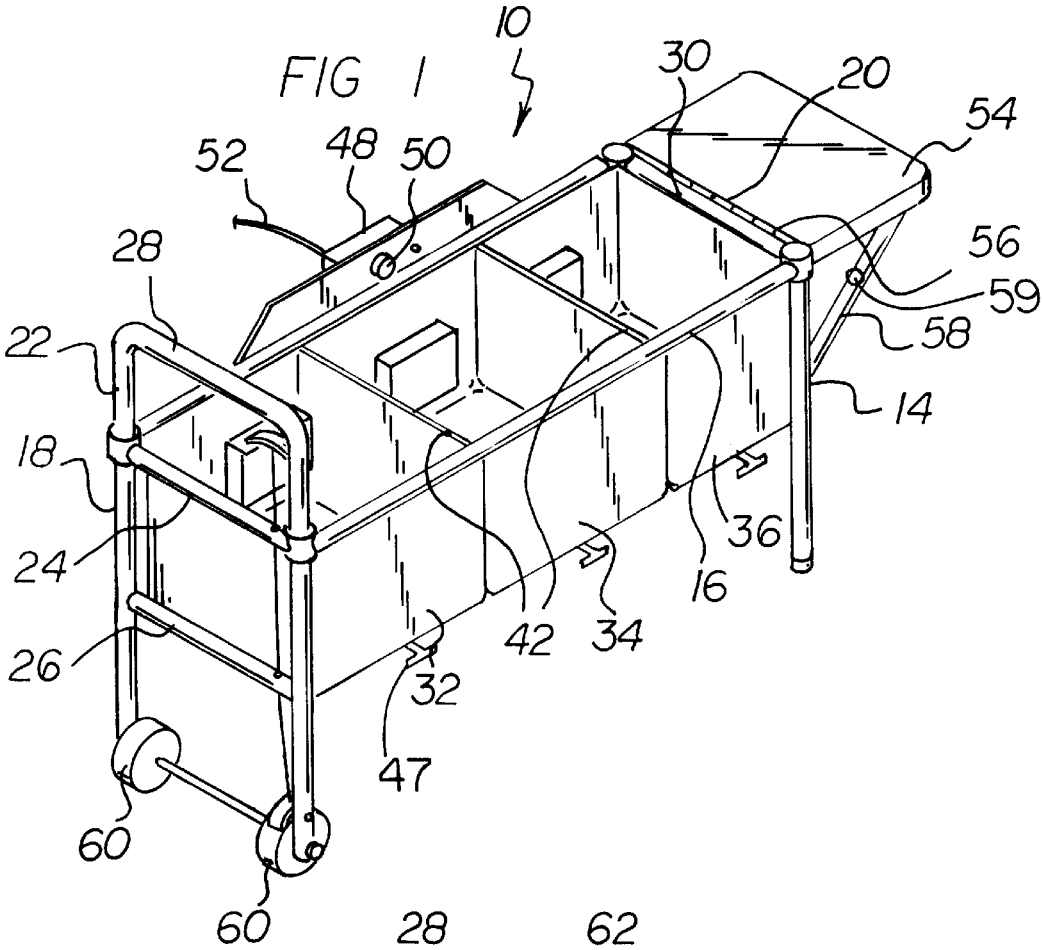
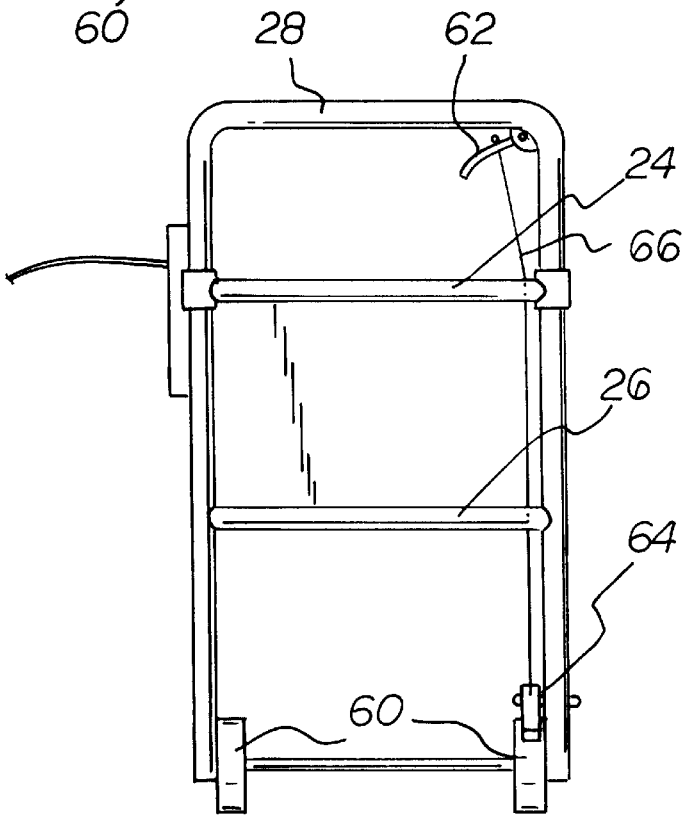
FIG 2

FIG 3
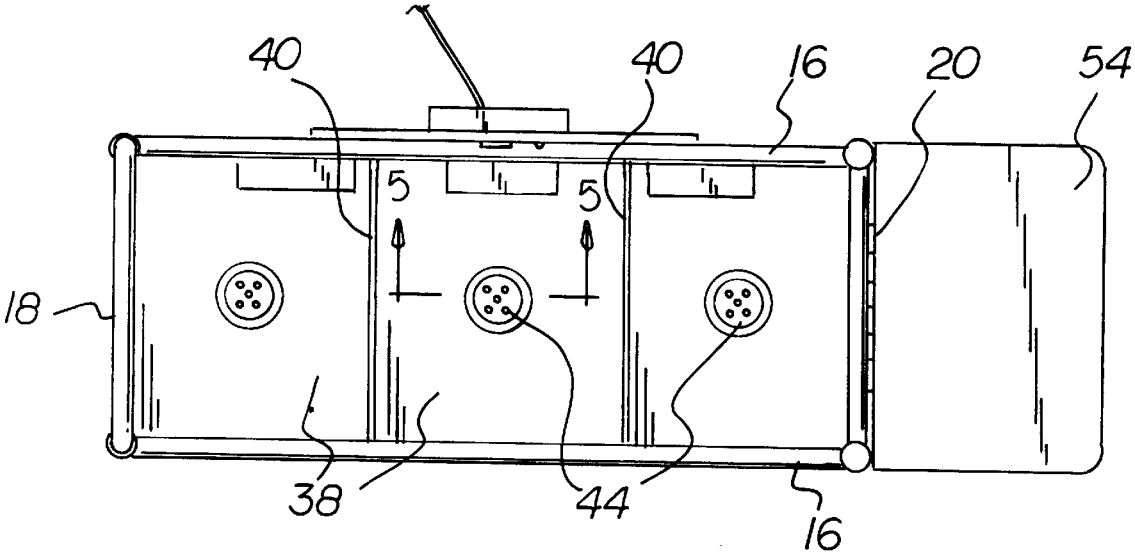
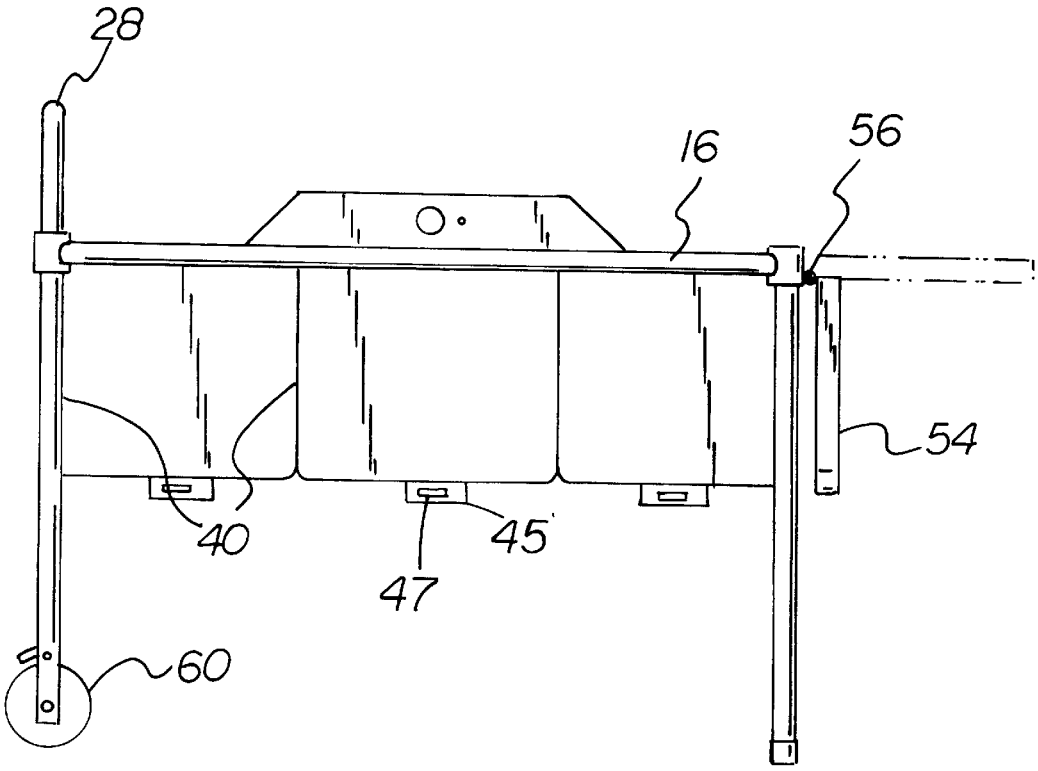
FIG 4

FIG 5
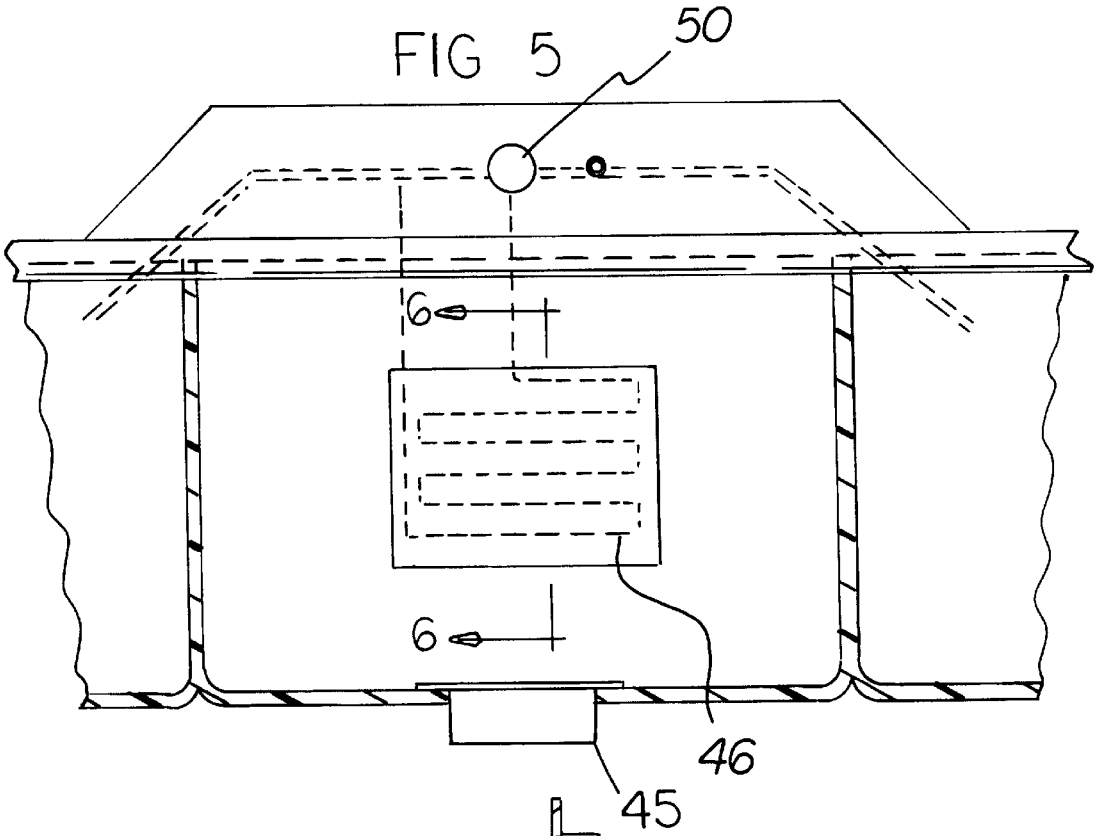
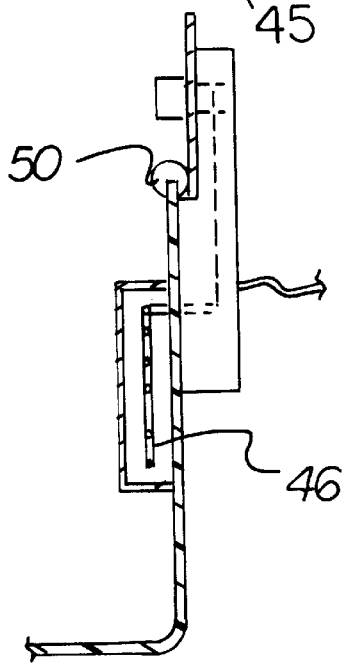
FIG 6

PORTABLE HOT SINK SYSTEM

BACKGROUND OF THE INVENTION

1. Field of the Invention

The present invention relates to a portable hot sink system and more particularly pertains to washing dishes at various locations.

2. Description of the Prior Art

The use of sinks of known designs and configurations is known in the prior art. More specifically, sinks of known designs and configurations heretofore devised and utilized for the purpose of washing dishes by known methods and apparatuses at any of a plurality of locations are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,526,539 to Bower et al. discloses a Portable Washing Cart. U.S. Pat. No. 4,998,302 to Silva discloses a Self-Contained Mobile Hygiene Cabinet. U.S. Pat. No. 3,013,280 to Coffman et al. discloses a Portable Shampoo Device. U.S. Pat. No. 4,765,003 to Chang discloses a Portable Hands-Free Wash Stand. Lastly, U.S. Pat. No. Des. 306,223 to Muirhead et al. discloses a Portable Parts Washer.

In this respect, the portable hot sink system according to the present invention substantially departs from the conventional concepts and designs of the prior art, and in doing so provides an apparatus primarily developed for the purpose of washing dishes at various locations.

Therefore, it can be appreciated that there exists a continuing need for a new and improved portable hot sink system which can be used for washing dishes at various locations. In this regard, the present invention substantially fulfills this need.

SUMMARY OF THE INVENTION

In view of the foregoing disadvantages inherent in the known types of sinks of known designs and configurations now present in the prior art, the present invention provides an improved portable hot sink system. As such, the general purpose of the present invention, which will be described subsequently in greater detail, is to provide a new and improved portable hot sink system and method which has all the advantages of the prior art and none of the disadvantages.

To attain this, the present invention essentially comprises a new and improved portable hot sink system for washing dishes at various locations comprises, in combination a frame that has two parallel upper elongated tubes about forty-eight inches in length with a first end and a second end. A first inverted U-shaped support is provided at about fifty-two inches in height and about forty-eight inches in width with two intermediate cross braces and an upper cross handle. A second inverted U-shaped support is provided at about thirty inches in height and about forty-eight inches in width. Also provided are three substantially similarly sized and shaped tubs. Each tub has closed rectangular lower ends and four upwardly extending generally rectangular vertical walls and with upper open ends. The central tub shares a common wall with the adjacent tubs. Drains are located within each of the tubs. Also provided is a heating element located within a vertical wall of each tub with electrical lines coupling the heating elements to a common control element with a common light at the control element to illuminate while the heating elements are actuated until the preselected temperature of about 180 degrees Fahrenheit is reached. A table is pivotally secured to the upper edge of the second support by a hinge with a brace to hold the table in an operative horizontal orientation. The brace is adapted to be moved for lowering the table to a vertical orientation when not in use. Lastly provided are two wheels which are rotatably secured to the lower end of the first support for transporting purposes. The wheels have an associated trigger coupled to the handle with a brake pad contactable with the wheels for locking purposes and with the brake pad movable away from the wheels by cables to retract the pad upon activation of the trigger.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved portable hot sink system which has all of the advantages of the prior art sinks of known designs and configurations and none of the disadvantages.

It is another object of the present invention to provide a new and improved portable hot sink system which may be easily and efficiently manufactured and marketed.

It is further object of the present invention to provide a new and improved portable hot sink system which is of durable and reliable constructions.

An even further object of the present invention is to provide a new and improved portable hot sink system which is susceptible of a low cost of manufacture with regard to both materials and labor, and which accordingly is then susceptible of low prices of sale to the consuming public, thereby making such portable hot sink system economically available to the buying public.

Even still another object of the present invention is to provide a portable hot sink system for washing dishes at various locations.

Lastly, it is an object of the present invention to provide a new and improved portable hot sink system comprising a frame having two parallel upper elongated tubes with a first end and a second end. The system also comprises a first inverted U-shaped support with two intermediate cross braces and an upper cross handle. A second inverted U-shaped support is provided with three substantially similarly sized and shaped tubs. Each tub has closed rectangular lower ends and four upwardly extending generally rectangular vertical walls and with upper open ends. The central tub shares a common wall with the adjacent tubs. Drains are located within each of the tubs. Lastly, a heating element is located within a vertical wall of each tub with electrical lines coupling the heating elements to a common control element with a common light at the control element to illuminate while the heating elements are actuated until the preselected temperature of about 180 degrees Fahrenheit is reached.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the preferred embodiment of the portable hot sink system constructed in accordance with the principles of the present invention.

FIG. 2 is a rear elevational view of the device shown in FIG. 1.

FIG. 3 is a top elevational view of the device shown in the prior Figures.

FIG. 4 is a side elevational view of the device of the prior Figures.

FIG. 5 is a cross-sectional view taken along line 5—5 of FIG. 3.

FIG. 6 is a cross-sectional view taken along line 6—6 of FIG. 5.

The same reference numerals refer to the same parts through the various Figures.

DESCRIPTION OF THE PREFERRED EMBODIMENT

With reference now to the drawings, and in particular to FIG. 1 thereof, the preferred embodiment of the new and improved portable hot sink system embodying the principles and concepts of the present invention and generally designated by the reference numeral 10 will be described.

The present invention, the portable hot sink system 10 is comprised of a plurality of components. Such components are individually configured and correlated with respect to each other so as to attain the desired objective.

More specifically, the new and improved portable hot sink system for washing dishes at various locations comprises, in combination, a frame 14 that has two parallel upper elongated tubes 16 about forty-eight inches in length with a first end 18 and a second end 20. A first inverted U-shaped support 22 is provided at about fifty-two inches in height and about forty-eight inches in width with two intermediate cross braces 24, 26, and an upper cross handle 28. A second inverted U-shaped support 30 is provided at about thirty inches in height and about forty-eight inches in width. Also provided are three substantially similarly sized and shaped tubs 32, 34, 36. Each tub has closed rectangular lower ends 38 and four upwardly extending generally rectangular vertical walls 40 and with upper open ends 42. The central tub shares a common wall with the adjacent tubs. Drains 44 are located within each of the tubs. As an option, each drain includes a valve 45 mounted to an underside of each tub with a push/pull rod extending therefrom past a front vertical wall of the tub for manually closing and opening the valve, respectively. In the alternative, the push/pull rod 47 may extend upwardly past a rear vertical wall of the tub for being manipulated by the user.

Also provided is a heating element assembly 46 located within a vertical wall of each tub with electrical lines coupling heating elements to a common control element 48 which is in turn connected with a common light 50 and an actuation switch. Power is supplied via an electrical line 52. The heating elements are preferably situated within a hermetically sealed conductive housing mounted within each tub. In use, upon the closing of the actuation switch, the common control element is adapted to illuminate the light and actuate the electrical elements for heating water within the tubs. Further, the common control element serves to turn off the light and deactuate the electrical elements when the preselected temperature of about 180 degrees Fahrenheit is reached in each of the tubs. As an option, the common control element may deactuate the heating assemblies independently as the desired temperature is reached. To accomplish this, the control element is preferably equipped with thermostats situated within each of the tubs. If the temperature drops below 180 degrees, the light is again actuated and the heating elements are actuated.

A table 54 is pivotally secured to the upper edge of the second support by a hinge 56 with a brace 58 to hold the table in an operative horizontal orientation. The brace is adapted to be moved for lowering the table to a vertical orientation when not in use. As shown in FIG. 1, the brace may optionally have a locking clasp 59 at a central extent thereof to secure the table in the horizontal orientation.

Lastly provided are two wheels 60 which are rotatably secured to the lower end of the first support for transporting purposes. The wheels have an associated trigger 62 coupled to an upper front corner of the handle with a brake pad 64 contactable with the wheels for locking purposes and with the brake pad movable away from the wheels by cables 66 to retract the pad upon activation of the trigger. As an option, the hand braking system/trigger/locking mechanism may be attached to each inner upper corner of the handle and attached to each wheel.

As described hereinabove, the system of the present invention is a commercial-type, three compartment sink that is used on a mobile basis. The system features three stainless steel sink compartments, each of which measure 15 inches long. Two of the sinks measure 11 inches deep, while the leftmost unit measures 13 inches deep and features a drain fitting in its lower center. The lower surface of each sink also incorporates a 110-volt AC heating element. These elements are linked to a thermostat that is able to maintain the water temperature in each at 180 degrees Fahrenheit. The thermostat features a ready indicator light on the rear center of the unit that alerts the user that the water temperature in each sink of the unit has reached its operating temperature.

The unit is supported by a stainless steel tubing perimeter frame. Pivotally attached to its right-hand end would be a 16 inch long table leaf extension. The extension is equipped with a hinged support brace that enables its outer end to be braced against the lower cross member of the unit's support structure. The support structure consists of two pairs of legs, each connected by a cross member. Those on the left side of the unit are equipped with a pair of lockable wheels. Extending from the upper ends of these two legs are a pair of extensions, the tops of which would be connected by another cross brace that acts as a handle.

The appealing features of the system of the present invention are its large capacity, strength, durability, ease of use, and efficiency. The stainless steel construction, three compartment design, and 180 degree operating temperature heating system of this sink enables it to meet with the codes established by most health departments. In use, it provides a fast, efficient, and easy to use method of cleaning and sanitizing dishes. It is also strong, durable and resistant to corrosion. Once drained, the system is easily moved around in a manner akin to a hand truck.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A portable hot sink system for washing dishes at various locations comprising:

a frame having two parallel upper elongated tubes with a first end and a second end, a first inverted U-shaped support with two intermediate cross braces and a upper cross handle, and a second support;

three tubs, each of the tubs having a closed lower end and four generally rectangular vertical walls extending upwardly from the lower end to an upper open end of the tub, a central one of the tubs sharing a common wall with each of the adjacent tubs;

drains located in each of the tubs;

a heating element located on a vertical wall of each tub with electrical lines coupling the heating elements to a common control element with a common light at the control element to illuminate when the preselected temperature is reached;

a table pivotally secured to the upper edge of the second support with a brace to hold the table in an operative horizontal orientation, the table having a vertical orientation for when the table is not in use; and two wheels rotatably secured to the lower end of the first support for transporting purposes, the wheels having a locking assembly for selectively locking the wheels against rotation.

2. The portable hot sink of claim 1 wherein the preselected temperature is about 180 degrees Fahrenheit.

3. The portable hot sink of claim 1 wherein the locking assembly includes a trigger coupled to the handle with a brake pad contactable with the wheels for locking the wheels against rotation purposes and with the brake pad movable away from the wheels by cables coupled to the trigger to retract the pad upon activation of the trigger.

4. The portable hot sink of claim 1 wherein each of the sinks includes a valve connected to the drain for selectively opening and closing the drain, and a valve actuating rod extending from the valve below the lower end to a location adjacent a front one of the vertical walls for permitting draining of water from the tub without reaching into water held in the tubs, wherein the valve of each drain is individually actuatable from a same side of the frame.

5. A portable hot sink system for washing dishes at various locations comprising, in combination:

a frame having two parallel upper elongated tubes about forty-eight inches in length with a first end and a second end, a first inverted U-shaped support with two intermediate cross braces and an upper cross handle, a second support about thirty inches in height and about forty-eight inches in width, three substantially similarly sized and shaped tubs, each having closed rectangular lower ends and four upwardly extending generally rectangular vertical walls and with upper open ends, the central tub sharing a common wall with the adjacent tubs;

drains located within each of the tubs;

a heating element located within a vertical wall of each tub with electrical lines coupling the heating elements to a common control element with a common light at the control element to illuminate when the preselected temperature of about 180 degrees Fahrenheit is reached;

a table pivotally secured to the upper edge of the second support by a hinge with a brace to hold the table in an operative horizontal orientation, the table having a vertical orientation for when the table is not in use; and two wheels rotatably secured to the lower end of the first support for transporting purposes, the wheels having an associated trigger coupled to the handle with a brake pad contactable with the wheels for locking purposes and with the brake pad movable away from the wheels by cables to retract the pad upon activation of the trigger.

* * * * *